United States Patent [19]

Land

[11] 4,294,152

[45] Oct. 13, 1981

[54] FILM PUNCH

[76] Inventor: Donald E. Land, 10000-½ E. 56th St., Raytown, Mo. 64133

[21] Appl. No.: 39,668

[22] Filed: May 16, 1979

[51] Int. Cl.[3] ..... B26D 5/08; B26D 5/18

[52] U.S. Cl. ..... 83/588; 83/620; 83/630; 83/633

[58] Field of Search ..... 83/582, 588, 599, 618, 83/620, 627, 630, 632, 633, 635, 690, 698

[56] References Cited

U.S. PATENT DOCUMENTS

| | | | |
|---|---|---|---|
| 1,884,398 | 10/1932 | Uxley | 83/633 |
| 2,028,848 | 1/1936 | Roscoe | 83/588 |
| 2,482,218 | 9/1949 | Segal | 83/633 |
| 3,164,050 | 1/1965 | Alldis | 83/633 |
| 3,196,725 | 7/1965 | Hulen | 83/633 |
| 3,269,239 | 8/1966 | Dixon | 83/620 |
| 3,385,152 | 5/1968 | Brown | 83/633 |
| 3,416,397 | 12/1968 | Preston | 83/633 |
| 3,469,486 | 9/1969 | Neilsen | 83/633 |
| 3,492,901 | 2/1970 | Smith | 83/633 |
| 3,715,947 | 2/1973 | Weisbeck | 83/698 |
| 3,763,732 | 10/1973 | Stursberg | 83/635 |
| 3,921,487 | 11/1975 | Otsuka | 83/633 |

*Primary Examiner*—J. M. Meister
*Assistant Examiner*—K. Bradford Adolphson
*Attorney, Agent, or Firm*—Harvey B. Jacobson

[57] ABSTRACT

A base defining an upwardly facing sheet supporting surface and an elongated support member is mounted on the base and projects upwardly from the sheet support surface. The support member includes spacer structure spacing portions of the support member from the base to define an open slot between the base and the spaced portions of the support member. A pair of aligned support blocks are supported from the support member above the opposite end portions of the slot and an elongated head extends between and is removably journaled from the support blocks. The portions of the support member spaced above the base define upstanding sleeve bores therein normal and opening into the slot and bearing sleeves are mounted in the sleeve bores and have elongated punch members reciprocately disposed therein. The base defines die bores below the slot and opening into the latter aligned with the sleeve bores. Die sleeves are disposed in the die bores. The head includes crank arm portions spaced therealong registrable with the sleeve bores. Elongated connecting link structures are pivotally connected at one set of corresponding ends to the crank arm portions and at the other set of ends to the upper ends of the punch members for shifting the punch members from positions within the sleeves above the slot to positions with the lower ends thereof projecting through the slot and into the die bores upon oscillation of the head.

2 Claims, 6 Drawing Figures

FILM PUNCH

BACKGROUND OF THE INVENTION

Sheet punching devices have been heretofore provided, such as those disclosed in U.S. Pat. Nos. 3,164,050, 3,196,725, 3,385,152, 3,469,486, 3,492,901 and 3,921,487. However, these previously known sheet punching devices are not, for the most part, constructed in a manner to provide precision punching with a minimum of effort and by structure designed specifically to offer ease of operation, extended periods of usage with only minimum maintenance and ease of repair, when necessary. Accordingly, a need exists for an improved sheet punching apparatus which may be utilized efficiently and will enjoy an extended lifetime of usage with minimum maintenance requirements and ease of repair, when necessary.

BRIEF DESCRIPTION OF THE INVENTION

The sheet punching apparatus of the instant invention includes removal punch member sleeves and die sleeves as well as removable punches and dies. Further, the sheet punching apparatus includes structural features which offer extended life expectancy with little maintenance requirements. In addition, the sheet punching apparatus is constructed in a manner whereby sheets may be accurately and cleanly punched with little effort.

The main object of this invention is to provide a sheet punching apparatus capable of accurately and efficiently punching sheet material.

Yet another object of this invention is to provide a sheet punching apparatus including actuator structure therefor offering considerable mechanical advantage during sheet punching operations.

A further object of this invention is to provide a sheet punching apparatus which will offer an extended operational lifetime with little maintenance requirements.

Still another important object of this invention is to provide a sheet punching apparatus constructed in a manner whereby repairs thereto, when necessary, may be readily made.

A final object of this invention to be specifically enumerated herein is to provide a sheet punching apparatus in accordance with the preceding objects and which will conform to conventional forms of manufacture, be of simple construction and easy to use as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
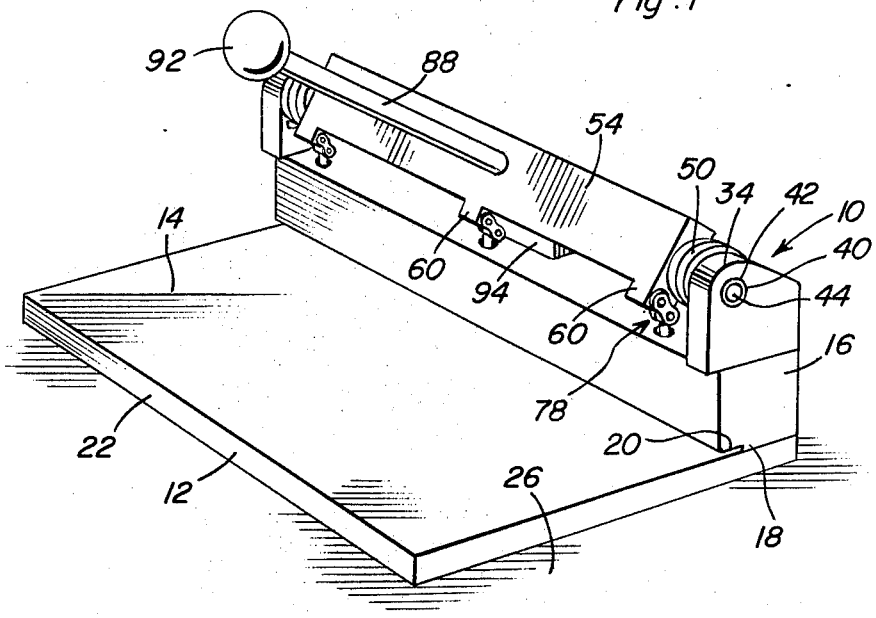
FIG. 1 is a perspective view of the sheet punching apparatus.

Referring now more specifically to the drawings, the numeral 10 generally designates the sheet punching apparatus of the instant invention. The apparatus 10 includes a horizontal base 12 including an upper support surface 14. An elongated support member 16 is provided and rests upon the rear marginal portion of the upper surface 14. The rear portion of the underside of the support member 16 includes depending spacer portions 18 which support the front marginal edge portion 20 above the upper surface 14 to define a horizontally opening elongated slot extending transversely of the base 12 and opening forwardly thereacross toward the forward edge 22 of the base 12.

The forward corners of the base 12 include downwardly opening blind bores 24 for receiving upwardly projecting indexing pins supported from the surface 26 upon which the base 12 is disposed and the rear corners of the base 12 include vertical bores 28 formed therethrough including lower end counterbores 30. The opposite ends of support member 16 have vertical bores 32 formed therein registered with the bores 28 and a pair of support blocks 34 having downwardly opening threaded blind bores 36 formed therein are supported on top of the opposite ends of the support member 16 with the bores 34 registered with the bores 32. Elongated headed bolts 38 are passed upwardly thrugh the bores 28 and 32 and are threadedly engaged in the bores 36 in order to removably support the support member 16 from the base 12 and the support blocks 34 from the opposite ends of the support member 16, the heads of the bolts 38 being seated in the counterbores 30.

The support blocks 34 include horizontally registered bores 40 formed therethrough, and the bores 40 have bearing sleeves 42 mounted therein. The remote ends of a pair of stub shafts 44 are journaled in the bearing sleeve 42 and the confronting faces of the support blocks 34 have bores 46 formed therein in which a pair of corresponding angulated ends 48 of a pair of coiled torsion springs 50 are removably seated.

The coiled springs 50 are disposed about the stub shafts 44 and the latter are supported from and project outwardly from the opposite ends of an elongated head 54. The head 54 includes blind bores 56 on its opposite ends corresponding to the blind bores 46 and in which second angulated ends 58 of the coiled springs 50 are removably anchored.

The head 54 includes crank arm portions 60 supported from the mid and opposite end portions thereof and the arm portions 60 project outwardly from the head 54 generally radially of the concentric center axes of the stub shafts 44.

The support member 16 includes a plurality of mid and opposite end plunger sleeve bores 62 formed therethrough opening downwardly into the slot 20 and the bores 62 have plunger bearing sleeves 64 removably mounted therein. Further, the base 12 includes a plurality of die bores 66 formed therein coaxial with the bores 62 and the die bores 66 include upper end counterbores 68 in which die sleeves 70 are removably seated.

A plurality of elongated punch members 72 are reciprocal in the sleeves 64 and include headed upper end portions 76. A plurality of connecting link assemblies referred to by the reference numerals 78 connect the arm portions 60 to the corresponding headed upper end portion 76. The connecting link assembly 78 each include a pair of side links 80 and the upper ends of each pair of side links 80 are pivotally anchored to opposite side portions of the corresponding arm portions 60 by means of a removable pivot fastener 82. The lower ends of each pair of links 80 are pivotally connected to the corresponding headed upper end portions 76 by a pivot fastener 84.

The central portion of the head 54 includes a threaded bore 86 in which one end of an operating arm 88 is threadedly engaged, the other end 90 of the operating arm 88 being threaded and having an operating knob 92 threadedly mounted thereon.

Figure 6:
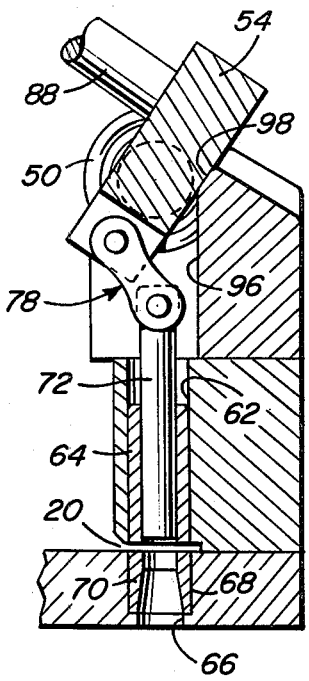
FIG. 6 is a fragmentary vertical sectional view similar to the right-hand portion of FIG. 4, but with the actuator of the punch in an alternate position.
Figure 4:
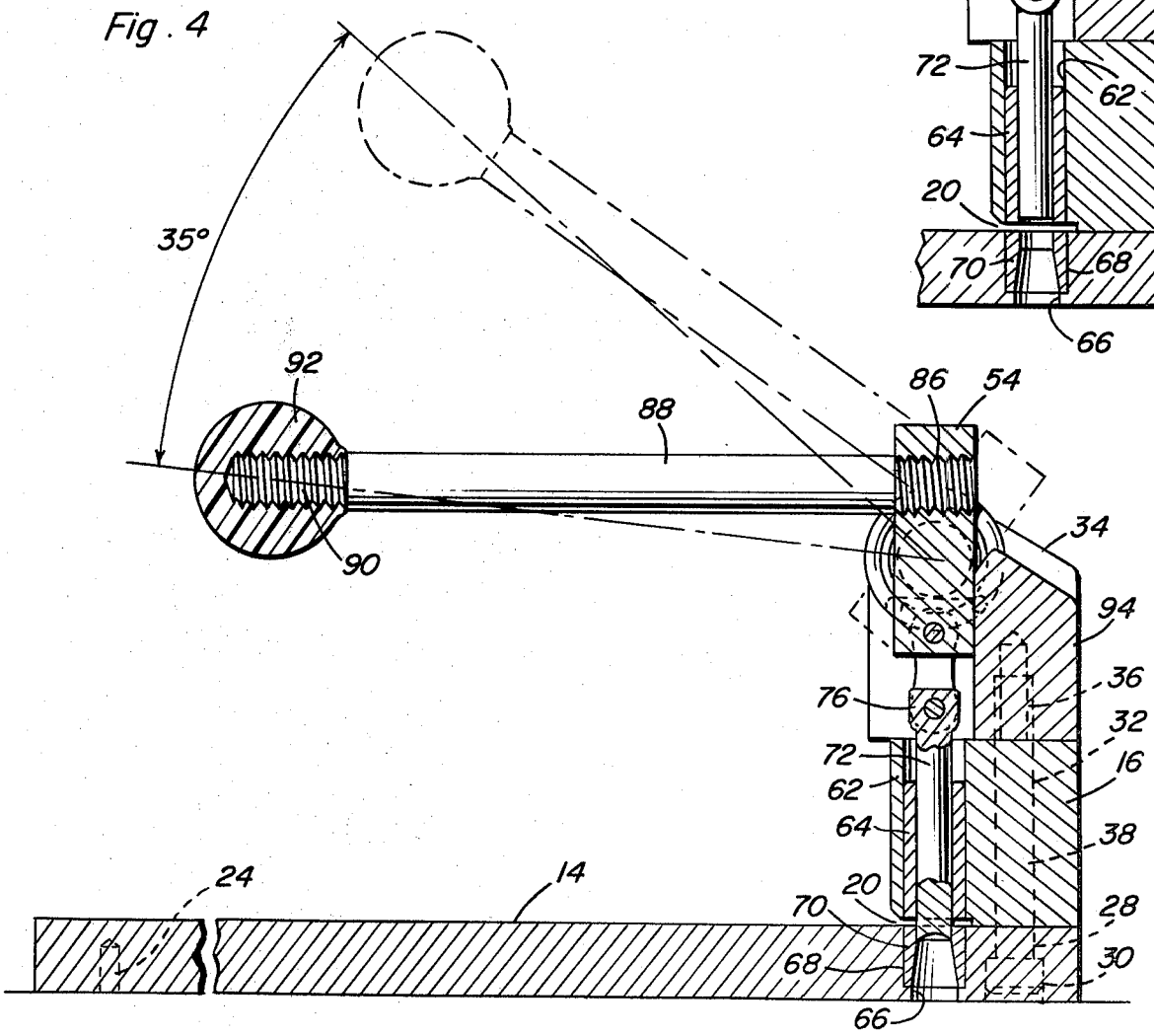
FIG. 4 is a fragmentary vertical sectional view taken substantially upopn the plane indicated by the section line 4—4 of FIG. 3.
Figure 2:
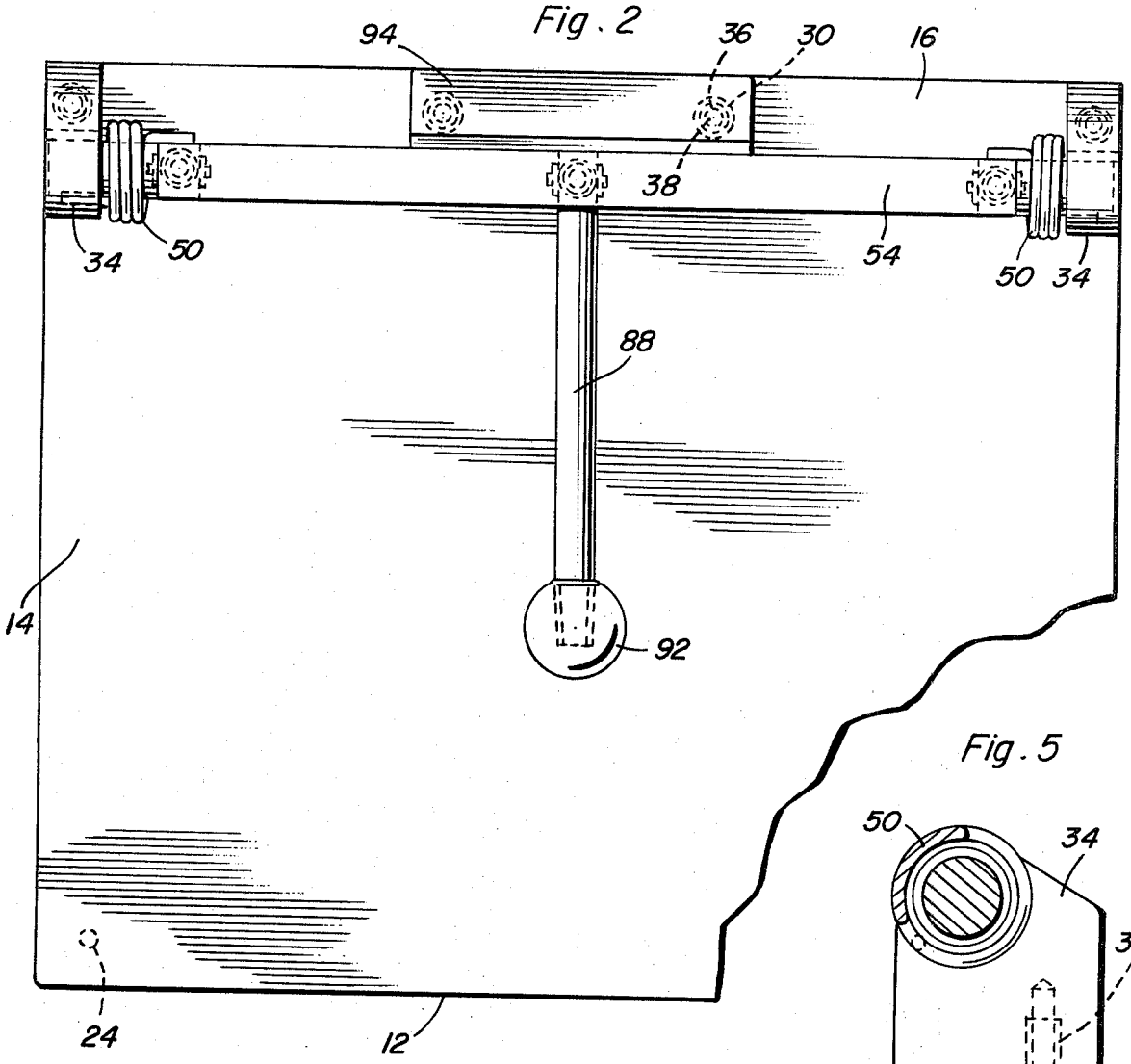
FIG. 2 is an enlarged fragmentary top plan view of the sheet punching apparatus.
Figure 5:
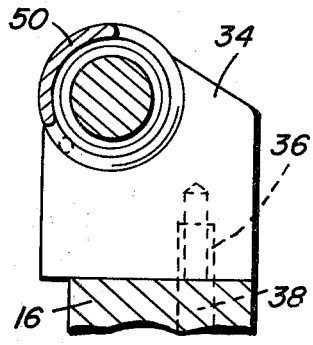
FIG. 5 is an enlarged fragmentary vertical sectional view taken substantially upon the plane indicated by the section line 5—5 of FIG. 3.
Figure 3:
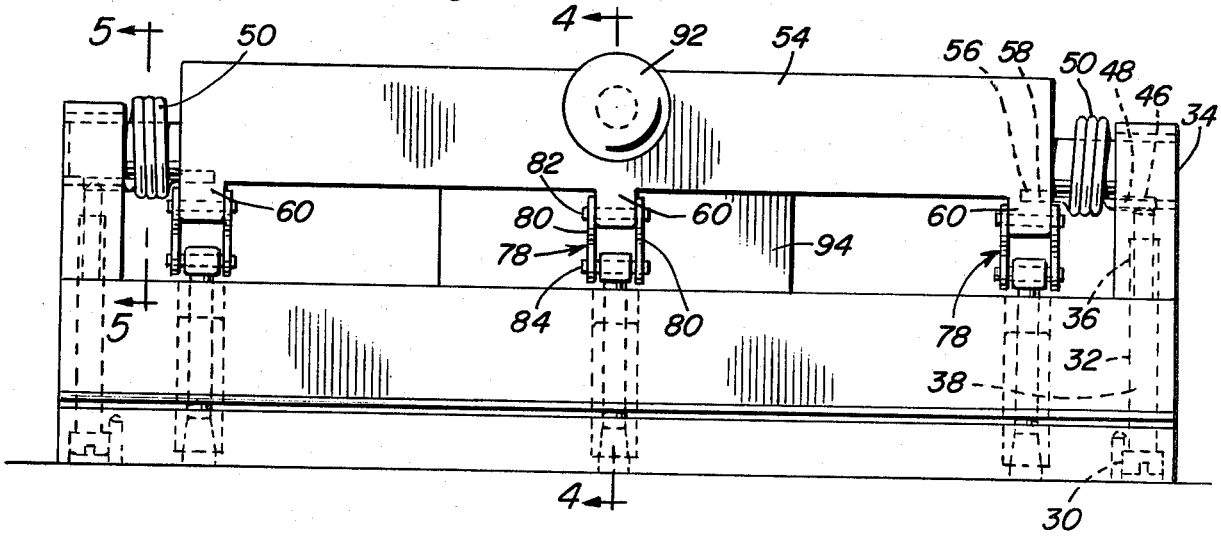
FIG. 3 is an enlarge front elevational view of the invention.

From a comparison of FIGS. 4 and 6 of the drawings, it may be seen that when the operating arm 86 is in the upper position thereof illustrated in phantom lines in FIG. 1 of the drawings and in solid lines in FIG. 6 of the drawings, the connecting link assemblies 78 raise the punch members 72 to positions with there lower ends spaced slightly above the slot 20. Further, when the operating arm 88 is in the lower position thereof illustrated in FIG. 4, the punch members 72 have their lower ends displaced downwardly through the slot 20 and into the upper ends of the die sleeves 70. Also, it will be noted that when the operating arm 88 is in the lower limit position thereof illustrated in FIG. 4 of the drawings, the connecting link assemblies 78 are substantially vertically disposed.

With attention now invited more specifically to FIGS. 4 and 6 of the drawings, it may be seen that the center portion of the support member 16 supports an abutment block 94 therefrom through the utilization of additional bolts 38 in the same manner in which the blocks 34 are supported from the opposite ends of the support member 16. Further, the abutment block 94 includes a forward face 96 abuttingly engageable by the lower portion of the head 54 to define the lower limit of swinging movement of the operating arm 88 as illustrated in solid lines in FIG. 4. Also, the abutment block 94 includes an upper inclined surface 98 abuttingly engageable by the head 54 to limit upward swingly movement of the operating arm 88 to the phantom line position thereof illustrated in FIG. 4.

Inasmuch as the sleeves 64 and 70 may be readily replaced and the punch members 72 as well as the connecting link assemblies 78 may be readily replaced, it is deemed readily apparent that the major operating components of the sheet punching apparatus 10 may be replaced, when necessary. Further, the sleeve 42 may also be replaced, if desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A sheet punching apparatus including a sheet supporting base defining a sheet supporting surface, an elongated support member mounted on said base and including a longitudinal central portion and opposite end portions, said support member projecting outwardly from said surface and including spacer means for spacing said support member from said base to define an open elongated sheet marginal edge receiving slot between said support member and said base extending along said support member and opening, laterally, across said surface, a pair of aligned support blocks removably supported from said opposite end portions of said support member outwardly from said surface and spaced along said slot, elongated shaft means including an elongated central head portion and opposite end portions extending between and removably journaled from said support blocks, a pair of coiled torsion springs disposed about said opposite end portions of said shaft means and operatively connected between said shaft means and said support blocks, said support member defining a plurality of sleeve bores formed therein and spaced therealong and disposed generally normal to said surface and opening into said slot, a plurality of bearing sleeves removably received in said bores above said slot, a plurality of generally parallel elongated punch members reciprocal in said sleeves and including first and second ends, said base defining a plurality of die bores formed therein aligned with said sleeve bores, a plurality of die sleeves disposed in said die bores, said central elongated head portion including crank arm portions spaced therealong registered with said sleeve bores, a plurality of elongated generally parallel connecting link structures pivotally connected at one set of corresponding ends thereof to said crank arm portions, and at the other set of corresponding ends to the first ends of said punch members, said longitudinal central portion of said support member including an abutment block supported therefrom, said head portion and abutment block including coacting abuttingly engageable portions defining first and second limit positions of oscillation of said head portion and shaft means relative to said base, said punch members, connecting link structures and crank arms being substantially aligned in one limit position of oscillation of said head portion with the second ends of said punch members disposed within said die sleeves, said head and crank arm portions being angularly displaced generally 35° from said first limit position when said head portion is disposed in the second limit position with said second ends of said punch members retracted across said slot and into said bearing sleeves, said springs yieldingly biasing said head portion to said second limit position, said head portion including a laterally outwardly projecting operating arm disposed at generally 90° relative to said crank arm portions.

2. The apparatus of claim 1 wherein said support member, support blocks and abutment block are removably supported from said base.

* * * * *